US008834949B2

(12) United States Patent
De Bortoli et al.

(10) Patent No.: US 8,834,949 B2
(45) Date of Patent: Sep. 16, 2014

(54) DOSING MACHINE FOR CONTROLLED DOSAGE OF PASTY PRODUCTS

(76) Inventors: Alessandro De Bortoli, Tricesimo (IT); Paolo Tosolini, Povoletto (IT)

( * ) Notice: Subject to any disclaimer, the term of this patent is extended or adjusted under 35 U.S.C. 154(b) by 1426 days.

(21) Appl. No.: 12/545,619

(22) Filed: Aug. 21, 2009

(65) Prior Publication Data

US 2010/0037904 A1 Feb. 18, 2010

Related U.S. Application Data

(63) Continuation of application No. PCT/EP2007/010478, filed on Dec. 3, 2007.

(30) Foreign Application Priority Data

Feb. 21, 2007 (IT) ..... UD2007A0041

(51) Int. Cl.

| | |
|---|---|
| ***A22C 7/00*** | (2006.01) |
| ***B65B 3/32*** | (2006.01) |
| ***B65B 37/10*** | (2006.01) |
| ***B65B 37/20*** | (2006.01) |

(52) U.S. Cl.

CPC . *B65B 3/32* (2013.01); *B65B 37/10* (2013.01); *B65B 37/20* (2013.01)

USPC ..... 426/512; 425/574; 425/556; 425/190; 426/516; 131/369

(58) Field of Classification Search

USPC ..... 425/135, 140, 238–239, 190, 574, 556; 426/512, 516; 131/369

See application file for complete search history.

(56) References Cited

U.S. PATENT DOCUMENTS

| | | | | |
|---|---|---|---|---|
| 1,659,802 | A | 2/1928 | Bergmann | |
| 3,720,980 | A * | 3/1973 | Gehlen et al. | 425/556 |

(Continued)

FOREIGN PATENT DOCUMENTS

| | | | |
|---|---|---|---|
| DE | 10335680 | B3 | 12/2004 |
| EP | 0135100 | A2 | 3/1985 |
| EP | 1426292 | A1 | 6/2004 |

OTHER PUBLICATIONS

International Preliminary Report on Patentability; PCT/EP2007/010478; Jan. 16, 2009; 5 pages.

(Continued)

*Primary Examiner* — Joseph S Del Sole
*Assistant Examiner* — Thukhanh Nguyen
(74) *Attorney, Agent, or Firm* — St. Onge Steward Johnston & Reens LLC

(57) ABSTRACT

Dosing machine for controlled dosage of pasty products, of the type with an agitator associated with a feed that includes an auger extension forming a compression feed chamber including a distributor with a plurality of distribution holes, a dosing device with on a fixed plate a corresponding first plurality of holes coinciding with the distribution holes and a corresponding second plurality of holes, parallel to the first and moved to one side on the plate, above the fixed plate a mobile dosing structure is installed that has an alternating drawer movement on the fixed plate with a reciprocal movement device for moving the dosing structure from a position above the distribution holes to a position above the second plurality of holes moved to the side of the auger and vice-versa, the dosing structure includes corresponding dosage chambers associated with the control dosing volume and density.

14 Claims, 3 Drawing Sheets

(56) References Cited

U.S. PATENT DOCUMENTS

| | | | | |
|---|---|---|---|---|
| 4,768,260 | A * | 9/1988 | Sandberg | 425/556 |
| 5,029,731 | A * | 7/1991 | Klatt | 222/54 |
| 6,238,196 | B1 * | 5/2001 | Hyllstam et al. | 425/139 |
| 6,360,920 | B1 * | 3/2002 | Corominas | 222/262 |
| 6,517,340 | B2 * | 2/2003 | Sandberg | 425/572 |
| 7,422,425 | B2 * | 9/2008 | Hansen et al. | 425/556 |
| 2005/0028886 | A1 | 2/2005 | Navarro et al. | |

OTHER PUBLICATIONS

International Search Report; PCT/EP2007/010478; Mar. 3, 2008; 3 pages.

* cited by examiner

DOSING MACHINE FOR CONTROLLED DOSAGE OF PASTY PRODUCTS

CROSS-REFERENCE TO RELATED APPLICATIONS

The present application is a continuation of pending International patent application PCT/EP2007/010478 filed on Dec. 3, 2007 which designates the United States and claims priority from Italian patent application UD2007A000041 filed on Feb. 21, 2007, the content of which is incorporated herein by reference.

FIELD OF THE INVENTION

The present invention relates to a dosing machine for controlled dosage pasty products of the type with an agitator associated with a feed auger device.

BACKGROUND OF THE INVENTION

The field of application is substantially aimed at dosing machines for pasty products in order to form the most exact product quantities possible.

In particular, the present machine is designed to make equal and uniform doses of Molase, namely of tobacco blended with flavouring substances and in particular with pasty sugar such as molasses. These doses must then pass to respective packaging for use.

Doses of Molase are very widely known in Arab countries where it is used for smoking with common hookahs. These doses, that generally take the form of cylindrical tablets of a few centimeters height and diameter, are sold in sealed sachets to be smoked.

The problems and drawbacks of the background art substantially refer to the fact that these doses are predominantly made by hand, first making provision for the mixing of the cut tobacco with said flavouring substances and then for the manual formation of said formed doses. These manual operations are expensive and furthermore manual dose production leads to the production of doses that have very variable weights since tobacco is notoriously elastic and in the paste it can have a different density. Therefore the resulting final dose is not always the same.

Machines have been designed to produce said doses. These machines comprise a kneader-mixer with a hopper that mixes the product and then carries it by means of a feed auger to a funnel applied at the head, so that the product substantially exits in the form of a salami without coating, which is cut into sections of uniform length as it exits.

Dimensional and weight parity cannot be guaranteed if production is mechanised in this way since the mixed material can have various densities at its mixing points, therefore when exiting prior to sectioning, similarly its density may vary. As a result, even if the doses are cut to a uniform length, one may be lighter than the other or vice-versa.

The scope of the invention is to resolve the aforementioned problems and drawbacks and in particular to allow not only the mechanisation of the formation of the doses but also to allow it in such a way that the doses are as identical as possible with respect to each other, both in terms of volume and, above all, in terms of weight.

SUMMARY OF THE INVENTION

The problem is solved with a dosing machine for controlled dosage pasty products of the type with an agitator associated with a feed auger device.

The sub-claims represent advantageous preferred solutions that provide improved performance.

In this way it is possible to obtain the advantage of:

Mechanising dose production, and

Obtaining doses with the same weight and with substantially identical shape and volume, the latter being made possible as the dosing device does not start to advance without first verifying that all the dosage chambers have been filled entirely.

The present invention involves a dosing machine for controlled dosage of pasty products, comprising: an agitator connected with a feed auger device, said feed auger device having an auger extension forming a compression feed chamber having a distributor with a plurality of distribution holes, a dosing device associated with said distributor, said dosing device having a fixed plate with a corresponding first plurality of holes coinciding with said distribution holes and a corresponding second plurality of holes, parallel to the first and moved to one side on the plate, wherein above said fixed plate is a mobile dosing structure that has an alternating drawer movement on said fixed plate by means of a reciprocal movement device for moving said dosing structure from a position back and forth from above said distribution holes to a position above said second plurality of holes moved to the side of said auger, and wherein said dosing structure further includes corresponding dosage chambers associated with means to control dosing volume and density.

The dosing machine may have the mobile dosing structure associated with a second regulation-adjustment device according to cylindrical axes and compressed-air pistons.

The dosing machine may have the reciprocal movement device be a dynamic-fluid cylinder whose shaft is associated with a movable sliding plate on which said dosage structure is associated with said dosage chambers.

The dosing machine may have the means for controlling dosage volume and density of said dosage chambers take the form of a small piston sensitive to pressure differences exerted by the compressed-air piston activating the small piston and the loading pressure of the material from below, the dosing machine being connected to a command system so that only when all said dosage chambers have reached the established volumetry of material loaded therein is consent given for said reciprocal movement device to move said dosage structure over said second plurality of holes, thus closing said first plurality of holes and taking it into alignment with said second plurality of holes in order to execute discharge through the latter with corresponding expulsion means represented by the small pistons themselves.

The dosing machine may have the dosage volume and density control means associated with commands for expelling the respective loaded doses when they coincide with the distribution feeding holes of said auger.

The dosing machine may have the volume control means be position sensors of said small pistons, such that the dosage density is adjusted by the opposite pressure exerted by said small pistons, the small pistons being elastically pressed in an adjustable way towards the side for loading/unloading that always takes place on the same side from the bottom upwards for loading and from above downwards for discharging.

The dosing machine may have the elastic pressure of the small pistons towards the loading/unloading side be such that, with the movement of said dosage chambers on the line on the side of the discharge holes and coinciding with the latter, the discharge of formed doses is determined.

The dosing machine may have a bridge-type upright structure placed on said movable plate which contains an aligned plurality of dose-forming chambers, overhung by small compressed-air pistons whose pressure can be adjusted, each provided with a contact sensor that can be adjusted precisely with a screw system, that act in internal cylinder pistons having variable forms, the assembly being axially adjustable according to the axes of the small compressed-air pistons and of the small internal pistons by means of a regulation-adjustment device.

The dosing machine may have the series of small piston chambers for the formation of doses placed above said auger.

The dosing machine may have the dosing device be dismantled, hooked and unhooked by means of a release action from the respective support structure.

The dosing machine may have for discharging the dosing machine, means to facilitate the expulsion of the doses, possibly a mechanical system.

The dosing machine may have for discharging the dosing machine, means to facilitate the expulsion of the doses by means of a compressed air blower system.

The present invention involves a method for preparing blended tobacco tablets with a dosage machine comprising the following steps: a) feeding a hopper with mixer-blender with the material to be dosed; b) feeding a feed auger duct towards a pressure accumulation blind chamber by means of said mixer-blender; c), using pressure to push the blended material, laterally to said auger towards aligned distribution holes with a constant section into respective dosage chambers by means of the continuous rotation of said auger; d) controlling the density and the volume of the product in the dosage chambers while said auger continues to rotate, and adjusting the pressure of the pneumatic pistons and the position of the pistons by means of contact sensors; e) determining when all said dosage chambers have reached the provided volumetry of material to be dosed, and moving said chambers over a series of discharge holes and at the same time blocking said series of distribution feeding holes; and f) repeating the cycle continuously as long as desired or planned.

BRIEF DESCRIPTION OF THE DRAWINGS

For a better understanding, the invention is described in a preferred solution with the aid of the attached Figures, in which:

FIG. 3. represents an axial vertical cross-sectional view of the mixer with hopper and respective underlying auger conveyor to carry the mixture to said dosing device that receives the material from below through a plurality of transversal conducts, each emptying into a dosage chamber, each dosage chamber including a flow adjustment system of the product to be dosed in the chamber, in such a way that the auger continuously supplies said chamber but the device starts to move the drawer only when each dosing chamber has been filled, by means of the adjustment system both of the flow of the product to be measured as well as of the volume of the chamber, independent for each chamber, thus guaranteeing the exact dosage weight. If a chamber is not completely filled, the device remains on stand-by.

DETAILED DESCRIPTION OF THE INVENTION

Figure 1:
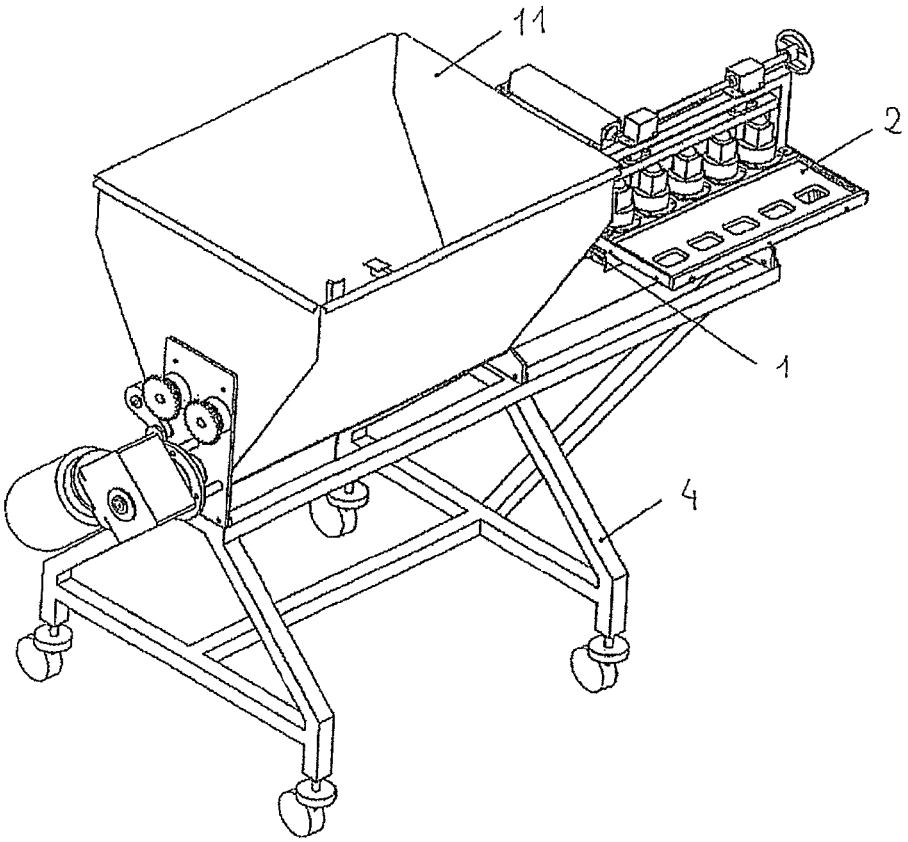
FIG. 1. represents a perspective schematic view of the dosing machine according to the present invention.
Figure 3:
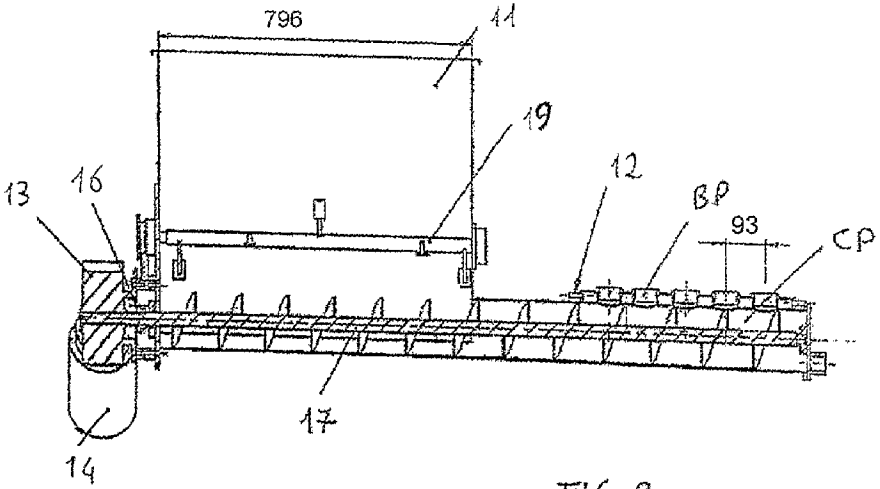

According to the Figures it is noted that the invention refers to a dosing machine comprising, optionally on a support provided with wheels, (4), a feeder (1) that comprises a hopper (11) for receiving the "Molase" tobacco that is the product to be dosed. Said hopper comprises a rotating axis with mixing blades (17) and under this axis an auger axis for conveying material, controlled rotationally by a ratio-motor (13, 14), provision also being made for transmission of rotational control by means of a sprocket and chain (16) to the mixing blade shaft (19) positioned above.

Said auger extends forward forming a compression feed chamber (CP), comprising a distributor (12) positioned transversally on the upper part that has a plurality of openings with a constant section directed upwards (BP).

The dosing device (2) is fixed above said distributor (12).

The dosing device can be fixed using release systems so that it can be unhooked and returned easily and can allow cleaning in the meantime.

Said dosing device (2) comprises a substantially drawer-type structure comprising a plurality of holes exactly aligned to coincide with those below of said distributor (12).

The dosing device therefore includes a fixed plate (21) as mentioned, fixed with release systems, comprising a double line of holes (F).

A dynamic-fluid piston (23) is installed on said structure, fixed at the head to the underlying structure (25), whose shaft (24) is connected to a sliding plate (22) above the first (21), capable of moving the drawer and comprising a series of material passage holes identical to those of the underlying distributor (BP).

A bridge-type upright structure (SM) is placed on said movable plate (22) which contains an aligned plurality of dose-forming chambers (222) overhung by small compressed-air pistons whose pressure can be adjusted, each provided with an axially adjustable contact sensor (221), that act on internal cylinder pistons having variable forms, the assembly being axially adjustable according to the axes of the small compressed-air pistons and the internal pistons by means of a regulation-adjustment device (wheel) (220).

Figure 2:
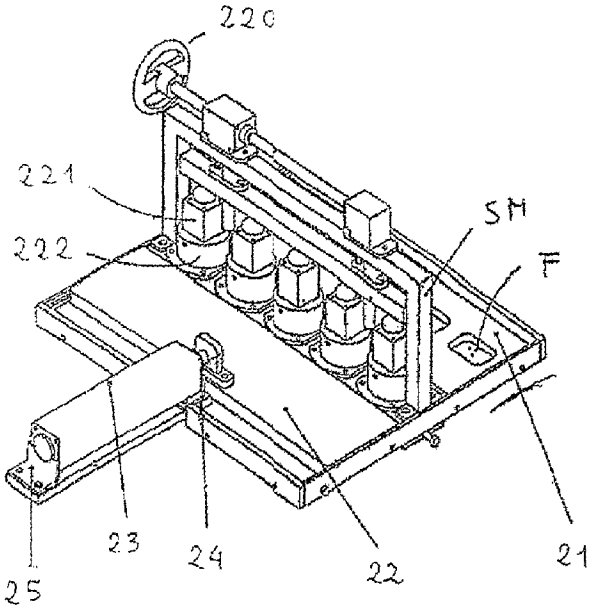
FIG. 2. represents a perspective view of the dosing device of the machine in FIG. 1.
Figure 5:
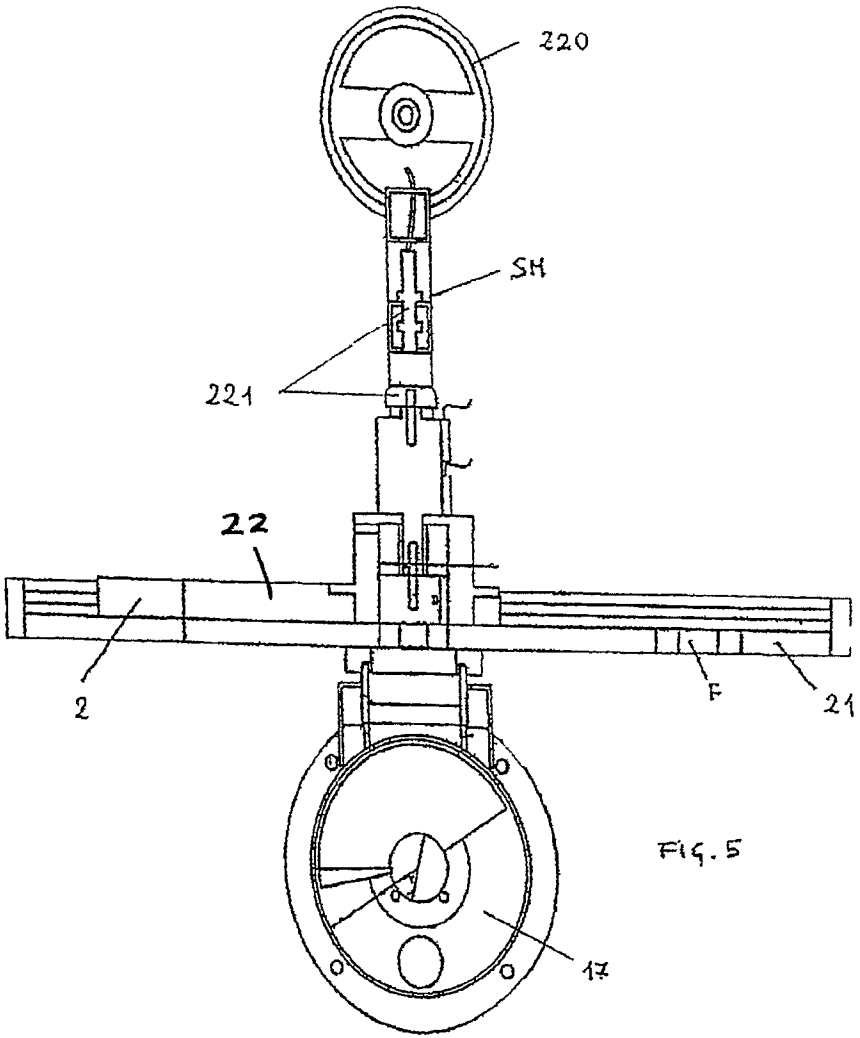
FIG. 5 represents an enlarged vertical cross-sectional view of the dosage system as in FIG. 4 where it is possible to see in the bottom part the feed auger with cylinders situated above with the drawer device for movement of the compacted doses for discharge on one side and above the position adjustment wheel frame.
Figure 4:
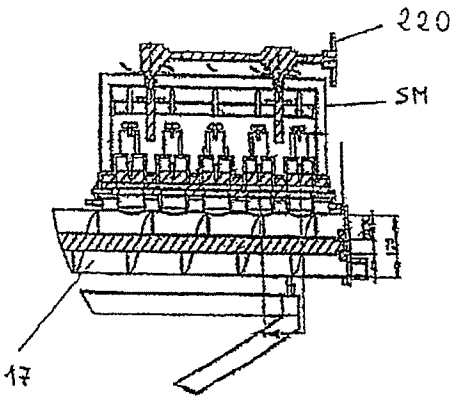
FIG. 4 represents a cross-section for view of the dosage chambers with the respective cylinders that allow the formation of the doses and that are associated with position sensor devices that allow the volume of the dose to be controlled.

In FIG. 2 such a device is seen in the forming position, namely when the drawer (22) is retracted.

In this position the auger feeds the material from below into the chambers (222) until the chambers (222) are full and contain pressure compacted material equal to that on the interior of the auger.

It is to be noted that the pressure exerted by the small pistons, which generate an opposite force to the pushing force of the product originating from inside the auger, serves to compact gradually and uniformly the product to be dosed, that with previous systems would take place excessively quickly, thus preventing the constant density of the tablet.

When all the contact sensors have found the pre-established position of the small piston shafts set with a precise adjustment system, for example with a screw system, a command is released that moves the piston shaft (24) that moves the frame (SM) forward with the filled chambers (222) above the line of holes (F) moving forward, as well.

In this way, the feeding of the material is interrupted by the plate (22), and when the line of dosage chambers (222) is exactly above the second line of discharge holes (F), the overlying small pistons receive the command to push the doses downwards through the holes (F) above the packaging material (film, trays, heat-sealing material etc.) or onto an underlying dose collector for transport to a packing device.

Naturally the execution details of this device can change.

Advantageously, the respective dosing volume and density control means are position sensors of said small pistons, the latter being subjected during loading of the dose to an adjustable pressure, opposite to that of the feed chamber CP. Said small pistons are therefore pressed elastically in a pressure-adjustable way towards the side for loading/unloading that always take place on the same side.

Advantageously the pistons, acting towards the loading/unloading side, move the dosage chambers on the line on the side of the discharge holes (F), coinciding with them and on command, also have the function of unloading formed doses. This can be favoured and/or by mechanical systems and/or by the blowing of compressed air.

As disclosed, the dosage chambers are arranged above the auger (17), in this way favouring the system of loading from below and drawer discharge on one side downwards in an adjacent area with a subsequent command.

While the invention has been specifically described in connection with certain specific embodiments thereof, it is to be understood that this is by way of illustration and not of limitation and that various changes and modifications in form and details can be made thereto, and the scope of the appended claims should be construed as broadly as the prior art will permit.

The description of the invention is merely exemplary in nature, and thus, variations that do not depart from the gist of the invention are intended to be within the scope of the invention. Such variations are not to be regarded as a departure from the spirit and scope of the invention.

What is claimed is:

1. A dosing machine for controlled dosage of pasty products, comprising:

an agitator connected with a feed auger device, said feed auger device having an auger extension forming a compression feed chamber having a distributor with a plurality of distribution holes, a dosing device associated with said distributor, said dosing device having a fixed plate with a corresponding first plurality of holes coinciding with said distribution holes and a corresponding second plurality of holes, parallel to the first and located on one side on the plate, wherein above said fixed plate is a mobile dosing structure that has a reciprocating movement on said fixed plate by means of a reciprocal movement device for moving said dosing structure from a position back and forth from above said distribution holes to a position above said second plurality of holes located on the side of said auger, and wherein said dosing structure further includes corresponding dosage chambers associated with means to control dosing volume and density, wherein material from the dosing device passes through said second plurality of holes during discharging.

2. The dosing machine of claim 1, wherein said mobile dosing structure is associated with a second regulation-adjustment device, the second regulation-adjustment device including cylindrical axes and compressed-air pistons.

3. The dosing machine of claim 1, wherein said reciprocal movement device is a dynamic-fluid cylinder whose shaft is associated with a movable sliding plate on which said dosage structure is associated with said dosage chambers.

4. The dosing machine of claim 1, wherein the means for controlling dosage volume and density of said dosage chambers take the form of a small piston sensitive to pressure differences exerted by the compressed-air piston activating the small piston and the loading pressure of the material from below, the dosing machine being connected to a command system so that only when all said dosage chambers have reached the established volumetry of material loaded therein is consent given for said reciprocal movement device to move said dosage structure over said second plurality of holes, thus closing said first plurality of holes and taking it into alignment with said second plurality of holes in order to execute discharge through the latter with corresponding expulsion means represented by the small pistons themselves.

5. The dosing machine of claim 1, wherein said dosage volume and density control means are associated with commands for expelling the respective loaded doses when they coincide with the second plurality of holes.

6. The dosing machine of claim 1, wherein said volume control means are position sensors of said small pistons, such that the dosage density is adjusted by the opposite pressure exerted by said small pistons, the small pistons being elastically pressed in an adjustable way towards the side for loading/unloading that always takes place on the same side from the bottom upwards for loading and from above downwards for discharging.

7. The dosing machine of claim 1, wherein the elastic pressure of said small pistons towards the loading/unloading side is such that, with the movement of said dosage chambers on the line on the side of the second plurality of holes and coinciding with the latter, the discharge of formed doses is determined.

8. The dosing machine claim 1, wherein a bridge-type upright structure is placed on said movable plate which contains an aligned plurality of dose-forming chambers, overhung by small compressed-air pistons whose pressure can be adjusted, each provided with a contact sensor that can be adjusted precisely with a screw system, that act in internal cylinder pistons having variable forms, the assembly being axially adjustable according to the axes of the small compressed-air pistons and of the small internal pistons by means of a regulation-adjustment device.

9. The dosing machine of claim 1, wherein said series of small piston chambers for the formation of doses is placed above said auger.

10. The dosing machine of claim 1, wherein the dosing device can be dismantled, hooked and unhooked by means of a release action from the respective support structure.

11. The dosing machine of claim 1, wherein for discharging the dosing machine includes means to facilitate the expulsion of the doses, possibly a mechanical system.

12. The dosing machine of claim 1, wherein for discharging the dosing machine includes means to facilitate the expulsion of the doses by means of a compressed air blower system.

13. A method for preparing blended tobacco tablets with a dosage machine comprising the following steps:

a) providing an agitator connected with a feed auger device, said feed auger device having an auger extension forming a compression feed chamber having a distributor with a plurality of distribution holes, a dosing device associated with said distributor, said dosing device having a fixed plate with a corresponding first plurality of holes coinciding with said distribution holes and a corresponding second plurality of holes, parallel to the first and located on one side on the plate, wherein above said fixed plate is a mobile dosing structure that has a reciprocating movement on said fixed plate by means of a reciprocal movement device for moving said dosing structure from a position back and forth from above said distribution holes to a position above said second plurality of holes located on the side of said auger, and wherein said dosing structure further includes corresponding dosage chambers associated with means to control dosing volume and density, wherein material from the dosing device passes through said second plurality of holes during discharging;

b) feeding a hopper with mixer-blender with the material to be dosed;

c) feeding the auger duct towards a pressure accumulation blind chamber by means of said mixer-blender;

d), using pressure to push the blended material, laterally to said auger towards aligned distribution holes with a constant section into respective dosage chambers by means of the continuous rotation of said auger;

e) controlling the density and the volume of the product in the dosage chambers while said auger continues to rotate, and adjusting the pressure of the pneumatic pistons and the position of the pistons by means of contact sensors;

f) determining when all said dosage chambers have reached the provided volumetry of material to be dosed, and moving said chambers over a series of discharge holes and at the same time blocking said series of distribution feeding holes; and g) repeating the cycle continuously as long as desired or planned.

14. A dosing machine for controlled dosage of pasty products, comprising:

an agitator connected with a feed auger device, said feed auger device having an auger extension forming a compression feed chamber having a distributor with a plurality of distribution holes, a dosing device associated with said distributor, said dosing device having a fixed plate with a corresponding first plurality of holes coinciding with said distribution holes and a corresponding second plurality of holes, parallel to the first and located on one side on the plate, wherein above said fixed plate is a mobile dosing structure that has a reciprocating movement on said fixed plate by means of a reciprocal movement device for moving said dosing structure from a position back and forth from above said distribution holes to a position above said second plurality of holes located on the side of said auger, wherein said dosing structure further includes corresponding dosage chambers associated with means to control dosing volume and density, wherein the means for controlling dosage volume and density of said dosage chambers take the form of one or more small pistons sensitive to pressure differences exerted by a compressed-air piston activating the small piston and the loading pressure of the material from below, and wherein the dosage of pasty products is gradually and uniformly compacted to provide a constant density of the dosage.

* * * * *